United States Patent [19]

Bond

[11] 4,359,737

[45] Nov. 16, 1982

[54] ARTIFICIAL TREES FOR ABSORBING AND SCATTERING RADIATION

[75] Inventor: John W. Bond, Churchton, Md.

[73] Assignee: The United States of America as represented by the Secretary of the Army, Washington, D.C.

[21] Appl. No.: 228,394

[22] Filed: Jan. 26, 1981

[51] Int. Cl.[3] ..... H01Q 17/00

[52] U.S. Cl. ..... 343/18 A; 343/18 E

[58] Field of Search ..... 343/18 A, 18 E

[56] References Cited

U.S. PATENT DOCUMENTS

| | | | |
|---|---|---|---|
| 2,881,425 | 4/1959 | Gregory | 343/18 |
| 3,187,331 | 6/1965 | Beller | 343/18 |
| 3,300,781 | 1/1967 | Clouth et al. | 343/18 |
| 3,307,186 | 2/1967 | Straub | 343/18 |
| 3,427,619 | 2/1969 | Wesch et al. | 343/18 A |
| 3,454,947 | 7/1969 | Wesch et al. | 343/18 A |
| 3,599,210 | 8/1971 | Stander | 343/18 A |
| 3,721,982 | 3/1973 | Wesch | 343/18 A |
| 4,001,827 | 1/1977 | Wallin et al. | 343/18 A |
| 4,034,375 | 7/1977 | Wallin | 343/18 A |
| 4,064,305 | 12/1977 | Wallin | 343/18 A X |
| 4,142,015 | 3/1979 | Bienz | 428/159 |
| 4,323,605 | 4/1982 | Rush | 343/18 E X |

*Primary Examiner*—T. H. Tubbesing

*Attorney, Agent, or Firm*—Nathan Edelberg; Robert P. Gibson

[57] ABSTRACT

Countermeasures apparatus is disclosed for attenuating radiation by absorption, reflection, and/or scattering, whether the radiation is reflected by or emanates from a target to be protected. The countermeasures apparatus comprises an artificial tree having a plurality of leaves disposed between the target to be protected and radiation sensors whereby the radiation directed from the target to the sensors is attentuated, the radiation being of a plurality of different wavelengths. Attenuating means are disposed on the leaves and take the form of an array of electrically conductive particles forming dipoles whose lengths are chosen to be 0.48 or approximately one-half of the wavelengths of the wavelength of the radiation to be defeated. The dipoles of the array are spaced from each other a spacing within an optimum range of one-half to one of the wavelength of the radiation of interest to effect coherent absorption and scattering of this radiation.

11 Claims, 4 Drawing Figures

Fig-1
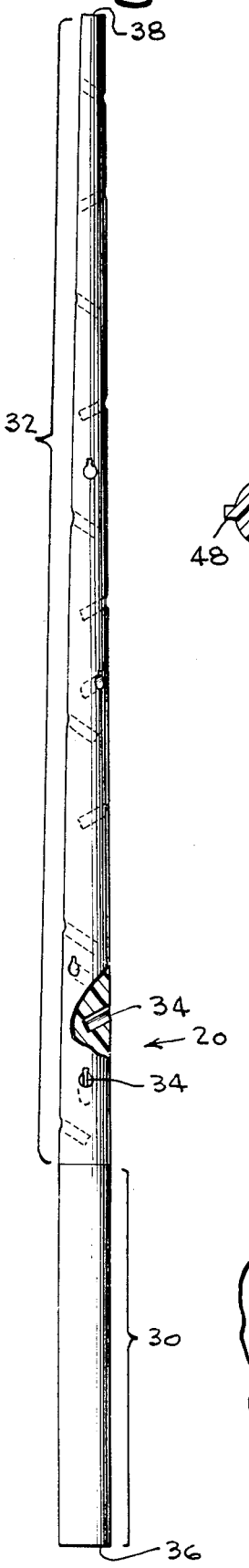
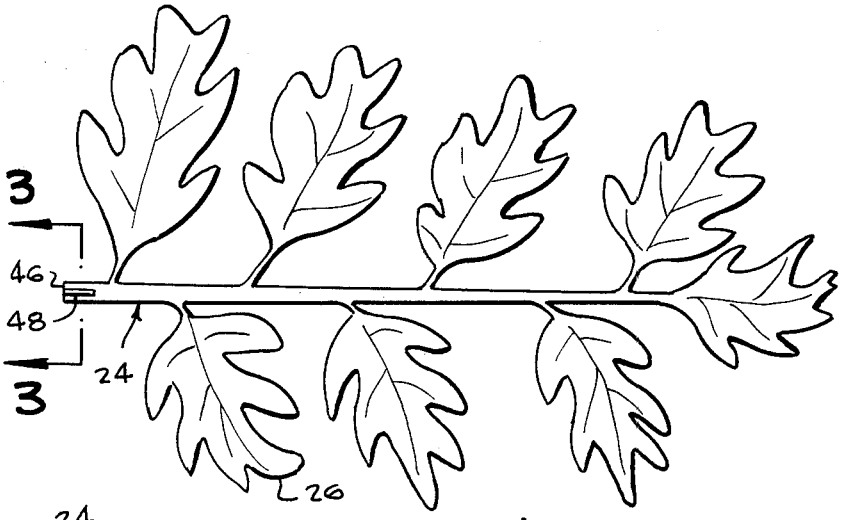
Fig-2
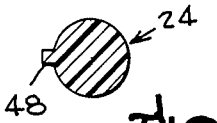
Fig-3
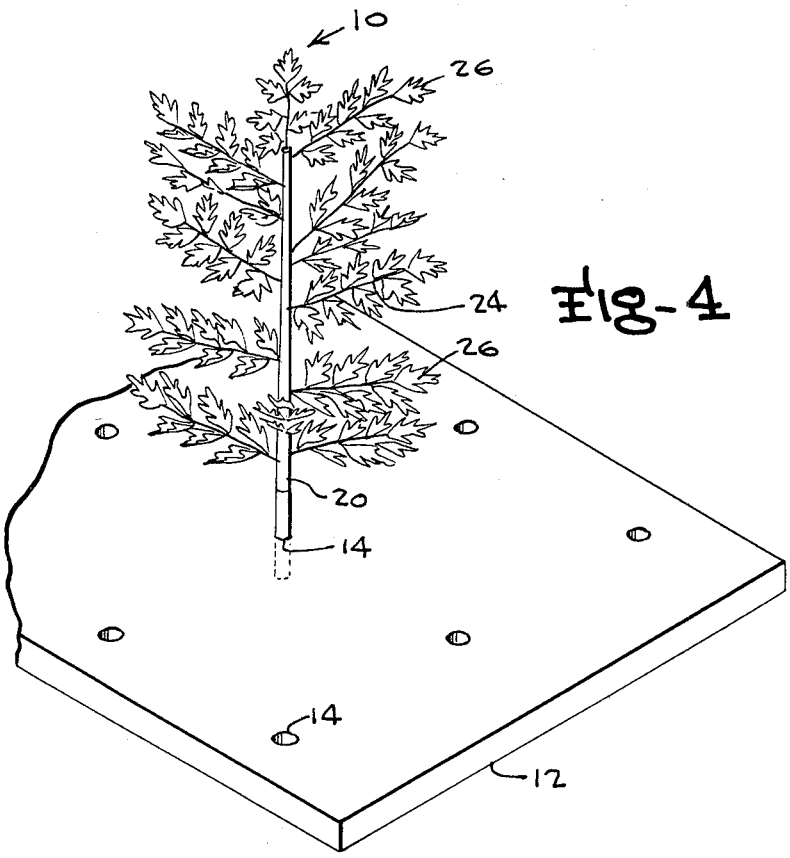
Fig-4

ARTIFICIAL TREES FOR ABSORBING AND SCATTERING RADIATION

The invention described herein may be manufactured, used, and licensed by or for the U.S. Government for government purposes without payment to me of any royalties thereon.

DESCRIPTION

Background of Prior Art

The present invention relates to apparatus for absorbing and/or reflecting radiation from an object or target to be hidden, and, more particularly, apparatus for protecting targets of a military nature from being detected by reflected or emitted radiation of a wide range of wavelengths.

Radiation over a broad spectrum may be used to detect, locate, or to recognize targets of a military importance. Radiation originating from natural sources, such as the sun, may be reflected from a target or absorbed by the target and readmitted to be detected by a sensor sensitive to the reflected radiation of a known wavelength. Artificially produced electromagnetic radiation may be generated and scanned across a field to be reflected by targets of interest. The more important types of radiation include: acoustic, ultraviolet, visual, near infrared, thermal infrared, millimeter wave, radar, and laser. Of the above, ultraviolet, visual, and near infrared radiation is typically reflected by the target to be sensed by a suitable sensor. By contrast, thermal infrared radiation is emitted from the target which has a surface temperature greater than that of its surroundings. Such targets typically take the form of a motor vehicle having an internal combustion engine; in addition, thermal infrared radiation may be generated by solar surface heating, friction, as would result from the movement of tank treads, or from the use of electric power. Sensors that are adapted to sense thermal infrared radiation also are capable of sensing extraterrestial or space radiation that is reflected by the target, typically at night. Another band of radiation of interest is millimeter wave radiation typically generated and directed toward targets. The millimeter wave radiation is reflected back from the target and is received by missile borne sensors to provide a reflected radiation signal for homing the missile toward the target. Similarly, radar radiation is generated by an airborne radar system to detect targets, the reflected radar radiation from the target being used to detect the presence, location, or to identify the target.

In the prior art, countermeasures are known for defeating detection by radar and in particular, for reflecting the radar radiation to prevent detection of airborne targets. In particular, window or chaff is the code name applied to airborne electronic reflector materials used for military purposes as a countermeasure means against enemy radar. Generally, window, which comprises strips of aluminum of various lengths, is dropped from an aircraft to provide a reflector for enemy radar waves which will create a false echo, i.e., an echo which is not from the target.

Window, as presently produced, is cut from thin rolled sheet aluminum in thin strips of lengths to correspond to a desired radio or radar wavelength against which it is used or it is cut in long ribbons, approximately one-half inch wide and five hundred feet long, and dispensed from rolls for use against long wavelength radio or radar waves. Such radar countermeasure means is disclosed in U.S. Pat. No. 2,881,425 of Gregory, wherein there is described a means for providing resonant dipole reflectors of short length corresponding to the wavelength of the radar radiation to be defeated and comprising a nonconductive sheet or base upon which there is disposed a very thin metallic coating of an electrically conductive material. The metallic coating is cut into predetermined electrical lengths corresponding to a dipole of one-half the length of a given radio or radar wave to be defeated. In particular, the dipoles are made of substantially one-half the wavelength to provide a resonant reflector for the radiation to be defeated. In an illustrative example, dipoles are made of aluminum strips approximately 56" in length to form resonant reflectors, and thereby reflect radio frequencies of 100 megacycles. To reflect radar waves, the reflector may be made 9/16 inch long to establish a resonant reflector for radar waves having a frequency in the order of 10 GHz. It is contemplated that such sheets may be rolled and dispensed from a flying airplane by unrolling and cutting the sheets to form dipoles, as described above, to defeat the detection of the airplane.

In U.S. Pat. No. 3,187,331 of Beller, there is disclosed countermeasure means for preventing the reflection of detectable magnitudes of radar radiation as opposed to producing false reflections. The disclosed means is comprised of a radar radiation absorber in the form of a blanket or cover disposed about a stationary target and designed to absorb the radar radiation. In particular, the absorption characteristics are provided by disposing elemental particles of a conducting material into a flexible sheet. Each particle is shaped to have a responsive relationship to the wavelength of the radiation to be absorbed. It is suggested that such conductive material have a low permeability and a low dielectric constant illustratively taking the form of a carbonyl iron powder. In one embodiment, the iron powder particles are of a spherical shape and have a microscopic size averaging about 5 microns. It is particularly stated that such particles are of equal size and shape and are distributed within the flexible cover so that no appreciable scattering of the radiation results.

A similar radar defeating countermeasure taking the form of a flexible cover is disclosed in U.S. Pat. No. 4,001,827 of Walin et al. The Walin et al. cover comprises a web in which there is distributed metal or graphite fibrils in a random isotropic orientation, the fibrils being secured to the nonwoven web by polymeric bonding material. The fibrils are small, having a typical diameter in the range of 4 to 20 microns and a length in the order of 3 to 30 millimeters, to provide a 6 decibel attenuation to radar signals.

U.S. Pat. No. 4,142,015 of Bienz discloses a method of defeating thermal infrared radiation by disposing a layer of foam plastic of a non-uniform thickness and/or density, whereby the degree of radiation insulation is thereby varied. It is suggested that materials such as polystyrene or polyurethane may be so layered upon vehicles such as tanks.

U.S. Pat. No. 3,300,781 describes a radar countermeasure means in the form of a blanket or cover having a continuous coating of a thin metallic conductive layer, the thickness of the layer selected to provide a limited transmittance to radiation in the infrared range.

U.S. Pat. No. 3,307,186 discloses a grid structure having a plurality of defraction elements disposed in a phase opposition array to defract the incoming electromagnetic radiation in the radar range, whereby the defracted components are added and subtracted in certain angles regarding the direction of the incident or incoming wave to thereby substantially attenuate the radar signal reflected from the target.

It is contemplated that an enemy may use a plurality of sensors for detecting any or all of the radiation ranges discussed above in order to detect and possibly destroy a military target. The prior art countermeasures are primarily adapted to defeat one or a limited number of ranges of radiation and have not been particularly adapted to be disposed upon moving vehicles. The blankets or covers, as referred to above, are adapted to be placed over stationary targets, including parked vehicles, such as tanks. However, such blankets must be removed and stored before the vehicle may be moved, only to be unpacked and to be disposed over the vehicle when it has come again to rest.

BRIEF SUMMARY OF THE INVENTION

It is therefore an object of this invention to provide new and improved multi-spectral radiation countermeasure means for defeating the detection by such radiation of a target.

It is a more particular object of this invention to provide a multi-spectral radiation countermeasure means for absorbing and/or scattering radiation of a wide variety of radiation ranges.

It is a still further object of this invention to provide a new and improved multi-spectral radiation countermeasure means that is readily adapted to be effective even while the vehicle is moving, thereby avoiding the necessity of removing and unpacking the countermeasure means each time the vehicle is moved.

In accordance with these and other objects of the invention, there is disclosed a countermeasures apparatus for attenuating radiation by absorption, reflection, and/or scattering, whether the radiation is reflected by or emanates from a target to be protected. The countermeasures apparatus comprises an artificial tree having a plurality of leaves disposed between the target to be protected and radiation sensors whereby the radiation directed from the target to the sensors is attenuated, the radiation being of a plurality of different wavelengths. Attenuating means is disposed upon the leaves of the artificial tree and is adapted to attenuate radiation of first and second wavelengths. The means for attenuating radiation of shorter wavelength is disposed upon those leaves located closer to a top end of the tree, whereas those means for attenuating radiation of longer wavelength is disposed on those leaves closer to a bottom end of the tree.

In a further aspect of this invention, the attenuating means may illustratively take the form of an array of dipoles whose lengths are chosen to be 0.48 or approximately one-half of the wavelengths of those first and second wavelengths of the radiation to be defeated. The dipoles of the array are spaced from each other a spacing within an optimum range of one-half to one of the wavelength of the radiation of interest to effect coherent absorption and scattering of this radiation. In essence, this arrangement would provide a permanent shaft dipole cloud with optimum coherent absorption properties for millimeter and radar (electromagnetic waves).

In a further aspect of this invention, the artificial tree comprises a trunk and a plurality of branches adapted to be removably mounted within holes of the trunk whereby the countermeasures apparatus may be rapidly assembled and disassembled. The system of this invention is referred to by the acronym TREESS indicative of a TACTICAL REFLECTED and EMITTED ENERGY SUPPRESSION SYSTEM.

BRIEF DESCRIPTION OF THE DRAWINGS

For a more complete understanding of the present invention, reference is hereby made to the drawings in which:

FIG. 1 is a side view of a part of the countermeasure means of this invention taking the form of a trunk;

FIG. 2 is a plan view of a branch having a plurality of leaves secured thereto and adapted to be mounted upon the trunk, as shown in FIG. 1;

FIG. 3 shows a cross-sectional view of the branch as taken above line 3—3 of FIG. 2; and FIG. 4 is a perspective view of an artificial tree assembled from the trunk of FIG. 1 and a plurality of branches, as shown in FIG. 2.

DETAILED DESCRIPTION OF THE INVENTION

Referring now to the drawings, and in particular to FIG. 4, there is shown countermeasure apparatus taking the form of a plurality of trees, each tree being designated with the numeral 10. Each tree 10 is mounted on a target to be protected and supports a plurality of leaves 26 which function in different manners including absorbing, reflecting, and scattering to attenuate radiation of a plurality of wave lengths. As a result, the radiation emanating from the target may not be used effectively to detect the presence of, locate, or identify the target, for example, a tank. A plurality of the trees, as shown in FIG. 4, are disposed in corresponding openings 14 within a base 12 to provide an array of trees whose leaves 26 are disposed between the target and enemy sensors adapted to sense radiation emanating from the target whereby the target is effectively hidden from the enemy. Though only a limited array as supported upon the rectangular shaped base 12 is shown in FIG. 4, it is understood that the base 12 may be modified and configured so as to provide coverage of any target to be protected.

As shown in FIG. 4, each tree includes a trunk 20 from which extends a plurality of branches 24, each branch having a plurality of leaves 26 disposed in a common surface disposed to intercept radiation as would be directed from the target to enemy sensors. More specifically, the surfaces in which the leaves 26 are disposed are generally parallel to the topmost surfaces of the base 12 and the target to be protected. As shown in FIG. 1, each trunk 20 may be made of a suitable dielectric material such as plexiglass and may be manufactured by molding to provide a solid structure. The trunks 20 of each tree 10 are, in an illustrative embodiment, varied in height from 0.5 to 1.5 meter to provide a variety of tree sizes and a natural appearance. Each trunk 20 includes a base portion 30 of a cylindrical construction extending from a bottom end 36 a length in the illustrative range of 0.5 to 1.5 meters and being of a substantially constant circular cross-section. As shown in FIG. 4, the bottom end 36 is configured to be supportively received in one of the openings 14 of the base 12. Though a common base 12 is shown in FIG. 1, it is contemplated that individual holders in the nature of that used to support a flag could be dispersed over the surface of the target, e.g., a tank. The dimensions of the trunk 20 are selected to make the trunk 20 relatively rigid, enabling its resistance to high winds and, in the case of vehicles such as tanks, to enable passage through dense brush, rivers, etc. The trunk 20 includes a truncated portion 32, tapering from the base portion 30 of a diameter of 2 cm to a top end 38 having a diameter of 1 cm. As is evident from FIGS. 1 and 4, no branches 24 are disposed to extend from the base portion 30 thus permitting air to circulate beneath the leaves 26 of each tree 10 and the dissipation of heat that may otherwise build up from a target, such as a tank, and thereby preventing the sensing of infrared radiation that would otherwise result from the collection of undissipated heat.

Referring now to FIG. 2, the branch 24 and its leaves 26 are shown. The assembly of leaves 26 and the branch 24 may illustratively be made as an integral structure by molding it of a suitable dielectric material such as plexiglass. The integral structure not only assures the desired structural integrity to insure passage of an assembled tree 10 through dense foliage but also permits orientation of each of the leaves 26 with respect to the target, to achieve the desired radiation attenuation. To insure the structural rigidity, each branch 24 is made of a cylindrical configuration of a diameter in the order of 0.2 cm and has a length that may vary from 40 cm to 8 cm. The leaves 24 are made of a shape and texture that depends on the location and environment. For example, if the trees 10 would be used in the southwest part of the United States, the leaves 26 may be configured as those of live oak trees. It is also contemplated that in certain regions the leaves may be configured as those of coniferous trees.

In FIGS. 1 and 4, there is shown the manner of assemblying the branches 24 and the trunk 20 to form a tree 10. As shown in FIG. 1, the truncated portion 32 of the trunk 20 has a plurality of holes 34 therein, the size of which have been enlarged for clarity in the drawing. The axis of the cylindrically shaped holes 34 is disposed at an angle of approximately 20° with respect to an axis 28 of the trunk 20. In this manner, the branches 24 are disposed to have a natural configuration. In order to permit the rapid assembly of the integral assemblies as formed by the branches 24 and leaves 26 to the trunk 20, each branch 24 has its bottom end 46 configured, as shown in FIG. 3. In particular, a key 48 projects radially outwardly of the perimeter of the branch 24 and mates with a slot within its hole 34 in the trunk 20. In this manner, the bottom end 36 of each branch 24 is rapidly disposed within its hole 34 to insure the correct orientation of the leaves, i.e., substantially parallel, to hide in a visual and radiation sense, the target from detection. In addition, the use of the key 48 prevents rotation of the branch 24 once it is disposed within its hole 34. The assembled tree 10, as shown in FIG. 4, is designed, as explained above, to withstand wind velocities in the order of 80 kilometers per hour while permitting the branches 24 a deflection of only 10°.

The disadvantages of some countermeasures means of the prior art, including nets and covers, are overcome in that the countermeasure apparatus of this invention may be left mounted upon the protected target, e.g., a tank, even as the target moves from one position to another without requiring that the countermeasures apparatus be disassembled and packed during movement only to be unpacked and repositioned when the target has come to a halt. On the other hand, when it is not necessary to deploy the countermeasures apparatus this invention, the branches 24 may be quickly disassembled from the trunk 20, and the integral assembly of the leaves 26 and the branches 24 may be packed flatly for transportation and storage.

As will be explained below, the leaves 24 are treated to have desired electromagnetic properties whereby radiation of a variety of wavelengths is either scattered, absorbed, and/or reflected. In the prior art, as described above, it is known to form dipoles from particles, the length of the dipoles being made a multiple of one-half the wavelength of the frequency of interest. By so configuring an electrically conductive particle, a single dipole, when considered by itself, acts as a resonating element to essentially deflect the radiation of interest. By contrast, the invention described herein relies on a different phenomenon termed coherent absorption and scattering, wherein an array of dipole elements, whose lengths are related to the length of the radiation of interest, is formed. The array of dipole elements is formed with the dipoles spaced from each other a distance within an optimal range to maximize the degree of coherent absorption and scattering of radiation of the wavelength of interest. In particular, it has been determined that each dipole should be made 0.48 or approximately one-half of the wavelength of the radiation to be defeated, whereas the dipole spacing is selected with an optimal range of 0.5 to 1 wavelength of the radiation of interest. As will be explained below, such dipoles are disposed preferably on the upper sides of the leaves 26, as shown in FIGS. 2 and 4. Because of the frequencies of interest, i.e., very high frequencies, the resultant particles are quite small and cannot be illustrated in the attached drawings.

Radiation in the millimeter wave range is generated by systems to be reflected by a target and the sensed reflected radiation used to direct a homing or smart missile to strike the detected target. There are four frequencies of interest within the millimeter wave range which are used in such missile guidance systems, i.e., 35 GHz, 94 GHz, 140 GHz, and 220 GHz. To defeat detection of a target by millimeter wave radiation, relatively small conductive particles forming electrical dipoles are disposed on the upper sides of the leaves 26, whereby the millimeter wave radiation striking and being reflected by a target is effectively attenuated, i.e., coherently absorbed and scattered by the array of dipoles in accordance with the teachings of this invention. In addition, such dipoles also enhance the reflectance of infrared radiation as generated from a tank back towards the tank thus also preventing its detection. As indicated above, electrically conductive particles are configured and dimensioned to form electrical dipoles wherein their length is made approximately one-half the wavelength of the above-noted frequencies of the microwave radiation, i.e., the dipoles are formed of lengths 0.428, 0.160, 0.107, and 0.068 cm corresponding to these frequencies. Each conductive particle has a substantially cylindrical configuration of a diameter of approximately 8 to 10 microns and of varying lengths, as indicated above.

By critically spacing such dipoles from each other in the optimum range of one-half to one wavelength of the radiation, the desired coherent absorption and scattering of the radiation occurs. In one embodiment of the invention, the dipoles are disposed in an arbitrary pattern by spraying under pressure the dipoles onto the upper sides of the leaves 26. Alternatively, the dipoles may be disposed through a sieve onto the upper sides of the leaves where they are retained by a suitable upper adhesive such as epoxy or one of the well-known camouflaging paints, including an alkyd binder and suitable pigments, to give the tree the color of natural foliage. The density of the sprayed or sieved dipole particles is selected to establish an average or effective spacing between adjacent particles within the optimum range of one-half to one wavelength of the radiation to be defeated to achieve the desired coherent absorption and scattering effect. In an illustrative embodiment, the density of sprayed or sieved dipoles of a length of 0.150 mm is selected to be 400 per $cm^2$ to provide an attenuation of the millimeter wave radiation of a frequency of 100 GHz in the order of 10 db. If the dipole density is increased above the optimum range, the resulting dispersement of dipoles tends to increasingly resemble a solid film of electrically conductive material and no longer effects the desired radiation absorption and scattering. In a preferred embodiment of this invention, it is contemplated that printed circuit techniques, as developed in the semiconductor industry, may be also employed to dispose an array of such dipoles whereby adjacent dipoles do not touch each other and their spacing may be more accurately determined to be within the optimum range.

As shown in FIG. 4, it is contemplated that the dipoles of shorter length be disposed upon those leaves 26 located adjacent the top end 38 of the tree 10, whereas the longer dipoles be disposed upon those leaves 26 disposed toward the bottom end 36. This configuration is desired because a dipole longer than one wavelength acts as a reflecting surface. Thus, the shorter wavelengths of millimeter wave radiation would be reflected if the longer length dipoles were disposed at the top of the tree 10 and possibly detected by enemy sensors. In an illustrative embodiment of this invention, the dipoles near the bottom of the trees may be made of steel or aluminum, both of which materials have an efficient reflectance quality for infrared radiation and further are capable of microwave dipole scattering. The dipoles disposed upon leaves 26 at the top 38 of the trees 10 may be made of an electrically conductive material such as carbon fiber. The material of which the leaves 26 is made is selected so as not to retroreflect radiation of microwave frequencies; in addition, the leaf material also insures that the upper surfaces of the leaves 26 have the same reflectivity to thermal infrared radiation as naturally occurring foliage, which is being simulated by the leaves 26.

Radiation in the radar range, and in particular in the X band, is used to detect military targets, and dipole elements similar to that described above to defeat millimeter wave radiation are disposed on the undersides of the leaves 26 located on the lower portions of the trees 10. The principal radar frequency of interest is 10 GHz, and one-half wavelength dipoles have a length of 1.5 cm. In an illustrative embodiment, dipoles having a length of 1 to 2 cm are disposed upon the leaves 26. In an alternative embodiment of this invention, it is contemplated that the leaves 26 be made of a fabric having conductors of approximately 8 to 10 micron diameter interwoven with suitable cloth fabric. By suitably spacing the conductors from each other, it is contemplated that an attenuation of approximately 20 db of radar radiation could be affected.

Another range of radiation to be reflected is the thermal infrared radiation, and this may be reflected by placing a thin layer of a highly reflective material, such as polished aluminum or stainless steel, on the underside of the leaves 26 disposed toward the bottom end 36 of the tree 10 to reflect the thermal infrared radiation back toward the target, where it is dissipated by circulating air, as described above. Infrared radiation of a wavelength in the order of 0.72 to 1 micron is typically absorbed by elements of water and carbon dioxide, as found in the atmosphere and typically is not used to detect or locate targets, whereas radiation having a wavelength in the ranges of 3 to 5.5 microns and 7.5 to 14 microns is not so absorbed and may be used to detect, locate, and identify targets. A layer as thin as 8 to 10 microns of reflective material is employed to achieve the desired reflectance of these wavelengths of thermal infrared radiation. In addition, a small amount of a selected absorbing material such as a material having crown molecules with ligand band structure may be employed as a part of the leaf material, one such structure illustratively being a material identified as 1A50S18.62KIP.

As suggested above, the trees 10 may be colored with either a suitable camouflaging paint or such pigments may be mixed with the plastic material as it is molded to simulate natural background foliage, thus making visual identification difficult in that its color blends with the naturally occurring background. In that regard, trees 10 of different lengths may be used to insure an irregular pattern as would normally be found in nature. In addition, the structure of the trees 10 tends to absorb or reflect noise generated by a vehicle so that the resultant noise would also be attenuated.

Thus, there has been shown and described countermeasures apparatus for substantially attenuating radiation of a wide variety of wavelengths by reflecting, absorbing, or scattering the radiation to prevent its detection by the sensors of an enemy. It is contemplated that an enemy would use radiation emitted from or reflected by a target to identify, locate, or detect the presence of the target. Further, the described countermeasures apparatus may be employed on moving vehicles without the necessity of removing and packing it each time the vehicle is moved. During those periods when countermeasure procedures are not necessary, the described countermeasure apparatus may be quickly disassembled and packed.

Numerous changes may be made in the above-described apparatus and different embodiments of the invention may be made without departing from the spirit thereof; therefore, it is intended that all matter contained in the foregoing description and the accompanying drawings shall be interpreted as illustrative and not in a limiting sense.

I claim:

1. Countermeasures apparatus for attenuating the flow of multi-spectral radiation of at least first and second wavelengths from a target to detectors thereof, said countermeasures apparatus comprising:

(a) an artificial tree adapted to be readily mounted upon the target and including a plurality of leaves disposed between the target and the sensors, said artificial tree made of a dielectric material; and (b) means disposed on said leaves for attenuating said radiation of each of said first and second wavelengths, thereby preventing detection of the target by the sensors.

2. The countermeasures apparatus as claimed in claim 1, wherein said artificial tree has a bottom end adapted to be mounted to the target and a top end, said radiation attenuating means comprising first means for attenuating radiation of the first wavelength and second means for attenuating radiation of the second wavelength longer than the first wavelength, said first means disposed upon said leaves closer to said top end of said artificial tree and said second means disposed on said leaves closer to said bottom end of said artificial tree.

3. The countermeasures apparatus as claimed in claim 1, wherein said radiation attenuating means comprises first and second pluralities of dipoles made of an electrically conductive material and having lengths selected to be approximately one-half of said first and second wavelengths, respectively.

4. The countermeasures apparatus as claimed in claim 3, wherein said artificial tree includes a bottom end adapted to be mounted on the target and a top end, said wavelength being longer than said first wavelength, said first plurality of dipoles being disposed on said leaves closer to said top end and said second plurality of wavelengths being disposed on said leaves closer to said bottom end.

5. The countermeasures apparatus as claimed in claim 1, wherein said radiation attenuation means comprises dipoles, said dipoles being disposed upon said leaves and spaced an effective distance from each other to effect coherent absorption and scattering of the radiation.

6. The countermeasures apparatus as claimed in claim 5, wherein there are first and second plurality of dipoles, said first plurality of dipoles are spaced from each other an effective distance within an optimum range of one-half to one of said first wavelength, and said second plurality of dipoles are spaced from each other an effective distance within an optimum range of one-half to one of said second wavelength.

7. The countermeasures apparatus as claimed in claim 6, wherein each of said first plurality of dipoles has a length equal to approximately one-half the first wavelength, and each of said second plurality of dipoles has a length equal to approximately one-half of the second wavelength.

8. The countermeasures apparatus as claimed in claim 1, wherein said artificial tree comprises a trunk and a plurality of branches adapted to be removably mounted from said trunk.

9. The countermeasures apparatus as claimed in claim 8, wherein said trunk comprises a bottom portion adapted to be mounted upon the target and an upper portion having a plurality of holes therein, each of said plurality of holes receiving a branch, each of said branches supporting a plurality of said leaves.

10. The countermeasures apparatus as claimed in claim 9, wherein each of said branches includes means for orienting said branch and its leaves with respect to the target whereby said radiation attenuating means is effectively disposed to attenuate the radiation.

11. The countermeasures apparatus as claimed in claim 9, wherein said bottom portion is of a sufficient length to form a space between the target and the lowermost branches and their leaves, whereby air is permitted to circulate in said space to effectively remove thermal radiation.

* * * * *